US009049941B2

(12) United States Patent
Clenet et al.

(10) Patent No.: US 9,049,941 B2
(45) Date of Patent: Jun. 9, 2015

(54) MATTRESS RETAINER SYSTEM FOR AN ADJUSTABLE BED

(75) Inventors: Alain Clenet, Santa Ynez, CA (US); Joseph Ermalovich, Santa Barbara, CA (US)

(73) Assignee: Ergomotion, Inc., Santa Barbara, CA (US)

( * ) Notice: Subject to any disclaimer, the term of this patent is extended or adjusted under 35 U.S.C. 154(b) by 456 days.

(21) Appl. No.: 13/367,616

(22) Filed: Feb. 7, 2012

(65) Prior Publication Data

US 2012/0198623 A1 Aug. 9, 2012

Related U.S. Application Data

(60) Provisional application No. 61/440,303, filed on Feb. 7, 2011.

(51) Int. Cl.

| | |
|---|---|
| ***A47B 71/00*** | (2006.01) |
| ***A47C 21/02*** | (2006.01) |
| *A47C 21/08* | (2006.01) |

(52) U.S. Cl.

CPC ..... *A47C 21/026* (2013.01); *A47C 21/022* (2013.01); *A47C 21/08* (2013.01); *A47C 21/028* (2013.01)

(58) Field of Classification Search

CPC .. A47C 21/026; A47C 21/022; A47C 21/028; A47C 21/08

USPC ..... 5/411, 482, 494, 498, 499, 493, 600, 5/658

See application file for complete search history.

(56) References Cited

U.S. PATENT DOCUMENTS

| | | | | |
|---|---|---|---|---|
| 4,297,754 | A | 11/1981 | Suniga | |
| 4,899,404 | A | 2/1990 | Galumbeck | |
| 6,233,764 | B1 * | 5/2001 | Orr | 5/496 |
| 6,687,935 | B2 * | 2/2004 | Reeder et al. | 5/691 |
| 6,889,396 | B2 | 5/2005 | Weinman | |
| 7,047,579 | B2 * | 5/2006 | Piana et al. | 5/411 |
| 7,392,555 | B2 * | 7/2008 | Danaher | 5/414 |
| 7,398,570 | B2 * | 7/2008 | Seago | 5/497 |
| 8,302,230 | B1 * | 11/2012 | Jarrett et al. | 5/655 |
| 8,701,227 | B2 * | 4/2014 | Rohr | 5/411 |
| 2005/0210587 | A1 | 9/2005 | Piana | |
| 2008/0115270 | A1 * | 5/2008 | McCarthy | 5/494 |
| 2010/0050339 | A1 | 3/2010 | Beard | |
| 2011/0302715 | A1 * | 12/2011 | Battaglia et al. | 5/493 |
| 2012/0198623 | A1 * | 8/2012 | Clenet et al. | 5/600 |

FOREIGN PATENT DOCUMENTS

WO WO 2008006133 A1 * 1/2008

* cited by examiner

*Primary Examiner* — Robert G Santos
*Assistant Examiner* — David E Sosnowski
(74) *Attorney, Agent, or Firm* — Felix L. Fischer

(57) ABSTRACT

A mattress retention system for adjustable beds employs a tension web attached to a top surface of an element of an articulating support structure. The tension web is inset from a longitudinal edge and lateral edges of the articulating support structure element and incorporates a first fastener moiety on an extending edge. A mating element is attached to the bottom surface of a mattress adjacent an edge to be restrained. The mating element incorporates a second fastener moiety for operable connection to the first fastener moiety and includes a web section having a first edge attached to the bottom surface of the mattress and a second edge carrying the second fastener moiety for flexibility in attaching the fastener moieties.

12 Claims, 15 Drawing Sheets

MATTRESS RETAINER SYSTEM FOR AN ADJUSTABLE BED

REFERENCE TO RELATED APPLICATIONS

This application claims priority of U.S. Provisional Application Ser. No. 61/440,303 filed on Feb. 7, 2011 entitled MATTRESS RETAINER SYSTEM FOR AN ADJUSTABLE BED the disclosure of which is incorporated herein by reference.

BACKGROUND

1. Field

This invention relates generally to the field of adjustable beds and more particularly to a structure incorporating releasably mating tension members extending from a surface of a mattress support element inset from an edge to the underside of the mattress adjacent a companion edge for restraining the mattress to prevent "lift" in the mattress due to its rigidity when flexed by the articulating support elements.

2. Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

The mattress employed with an articulating bed is typically a dense foam construction for adequate support and comfort of the user. Due to the relative rigidity of the foam, when the bed is articulated the mattress tends to resist bending, at least to a degree, and rises from one or more support surfaces on the structure of the bed. This rising effect can be deleterious since relative support is lost beneath the elevated portion and addition of weight may cause a rapid shift in position which is undesirable. Additionally, accurate positioning of the bed is difficult since mattress position may shift.

Prior art articulating bed systems employ rigid frame elements extending from the bed support structure at the foot of the mattress to retain the mattress over the articulated frame as disclosed in copending U.S. patent application Ser. No. 12/154,509 filed on May 23, 2008 issued as U.S. Pat. No. 7,930,780 on Apr. 26, 2011 entitled ADJUSTABLE BED FRAME ASSEMBLY having a common assignee with the present invention. While effective in maintaining the longitudinal and lateral position of the mattress, these prior art devices may interfere with applying bedding to the mattress, particularly fitted sheets rendering making the bed somewhat difficult. Additionally, such retention devices may allow lateral motion of the mattress during change of articulated position.

It is therefore desirable to provide a retention system for the mattress on an articulating bed which restrains the mattress for both longitudinal and lateral motion and allows easy make up of the bed with bedding including fitted sheets.

SUMMARY

The embodiments disclosed herein overcome the shortcomings of the prior art by providing a mattress retention system for adjustable beds using a tension web attached to atop surface of an element of an articulating support structure. The tension web is inset from a longitudinal edge and lateral edges of the articulating support structure element and incorporates a first fastener moiety on an extending edge. A mating element is attached to the bottom surface of a mattress adjacent an edge to be restrained. The mating element incorporating a second fastener moiety for operable connection to the first fastener moiety.

In an example embodiment the mating element includes a web section having a first edge attached to the bottom surface of the mattress and a second edge carrying the second fastener moiety for flexibility in attaching the fastener moieties.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1:
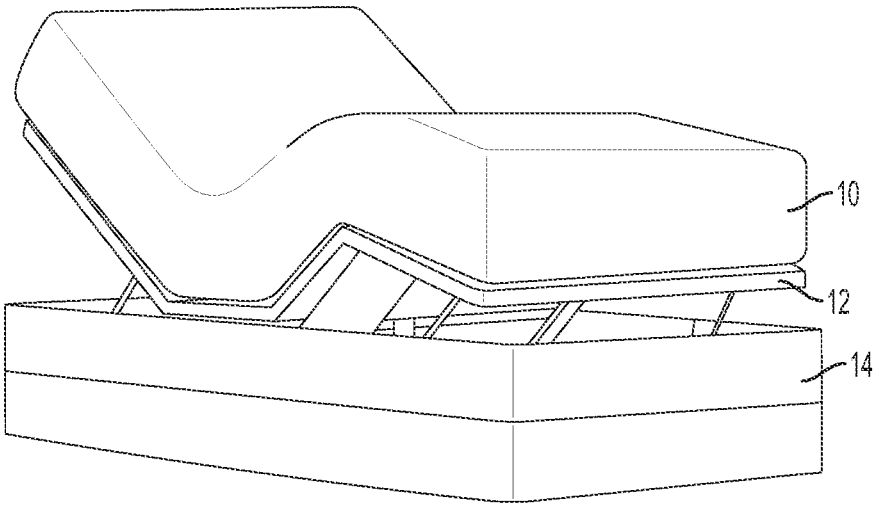
FIG. 1 is a top isometric view of an adjustable bed showing the mattress atop the support elements in an articulated position.
Figure 2:
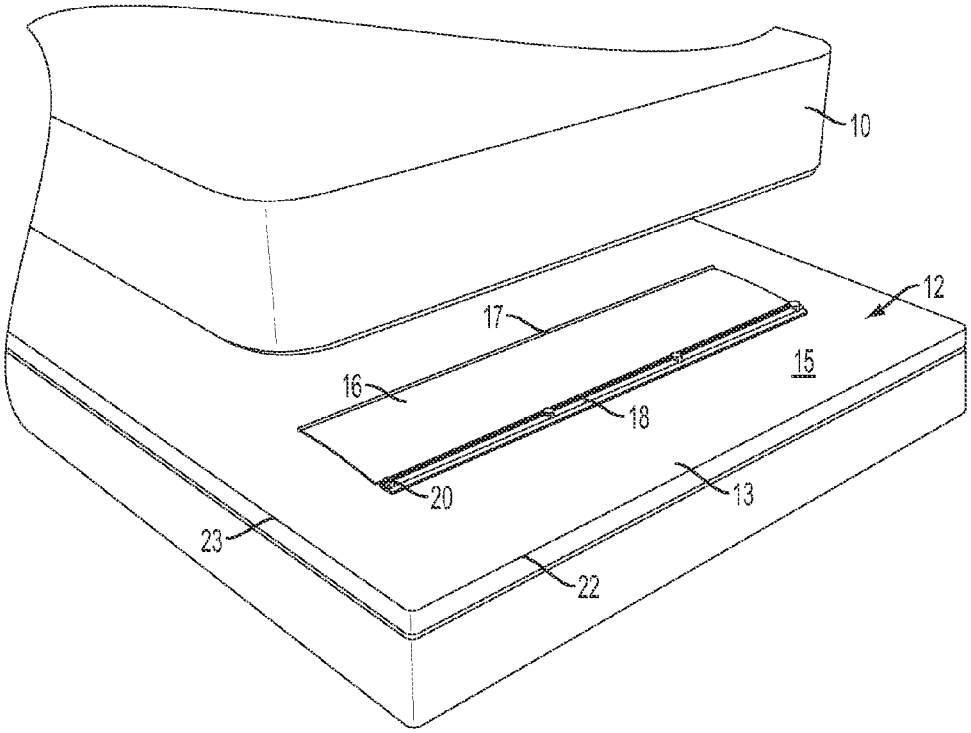
FIG. 2 is top isometric view of the bed portion of the device shown with the mattress lifted from the bed and the web lying horizontal in a reversed position on the support element.
Figure 3:
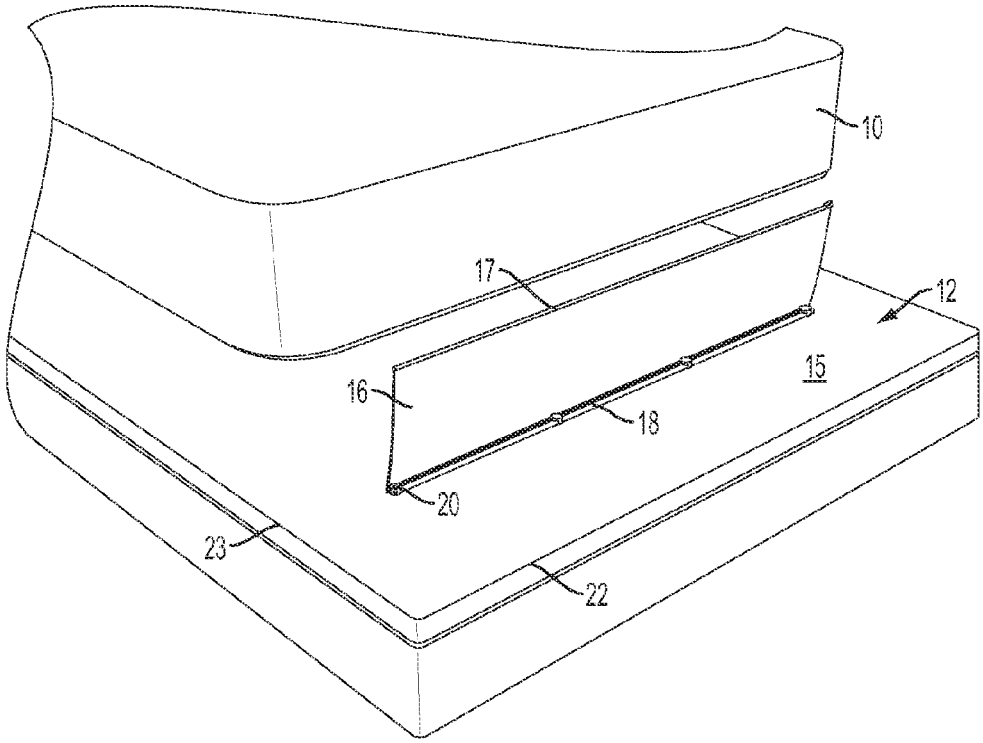
FIG. 3 is a top isometric view of the bed portion of the device with web vertical extending from the support element.
Figure 4:
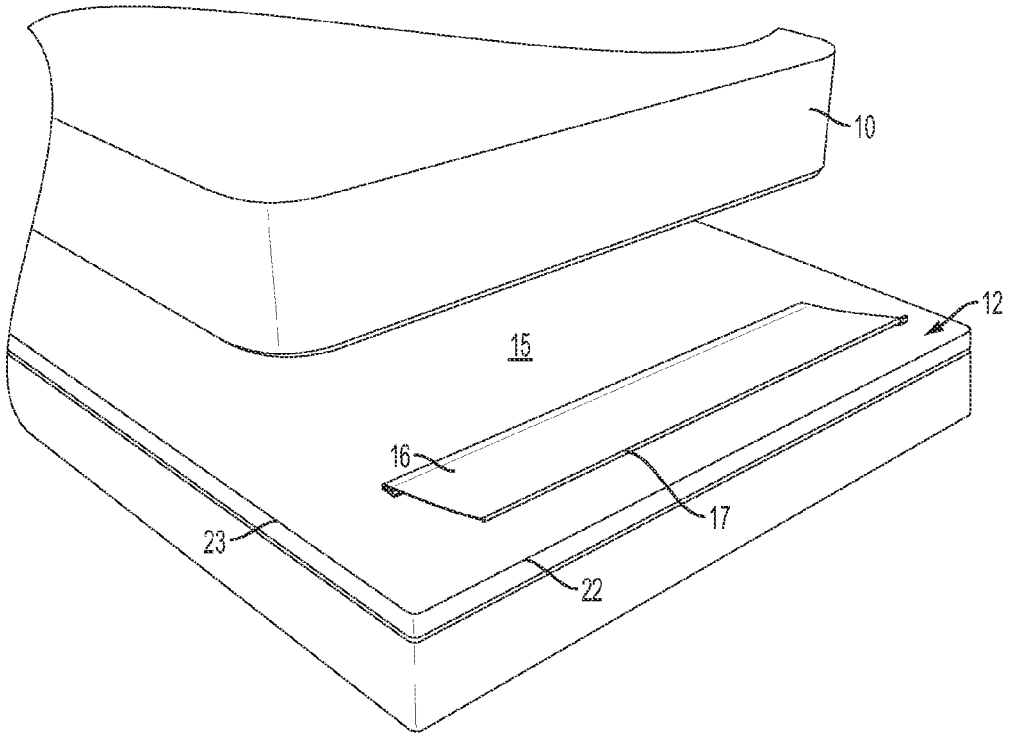
FIG. 4 is a top isometric view of the bed portion of the device with the web folded substantially in the operable position.
Figure 5:
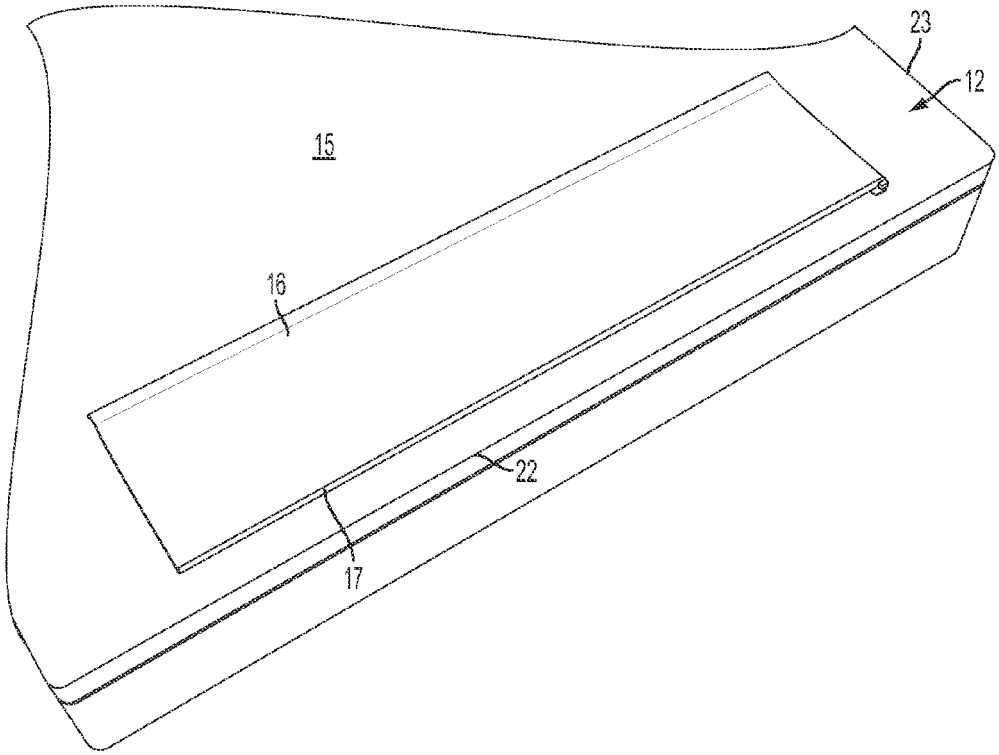
FIG. 5 is a top isometric view of the bed portion of the device with the web folded in the operable position and the mattress removed for clarity.

Embodiments shown in the drawings and described herein provide a mattress retention system for adjustable beds as shown in FIG. 1 wherein the mattress 10 rests atop an articulating support structure 12 extending from a support base 14. As shown in FIGS. 2-6, a restraining web 16 having a fastener first moiety 17 on an extending edge is attached to the top surface 15 of a foot support member 13 of the articulating support structure 12 with a tension strip 18, which for the example embodiment is wood but may be any suitable rigid material, and multiple mechanical fasteners 20. As shown in FIG. 2 with the web lying inward on the foot support member, the tension strip is placed well inboard from a longitudinal edge 22 of the foot support member to capture an attachment edge of the restraining web. The width of the web extends across only a center portion of the overall width of the foot support member inset from the lateral edges 23 of the bed. As shown in FIG. 3, the restraining web is flexible and can be rotated around the tension strip. In the operable position, the web is folded onto the surface of the foot support member extending toward the edge 22 as shown in FIGS. 4 and 5.

Figure 6:
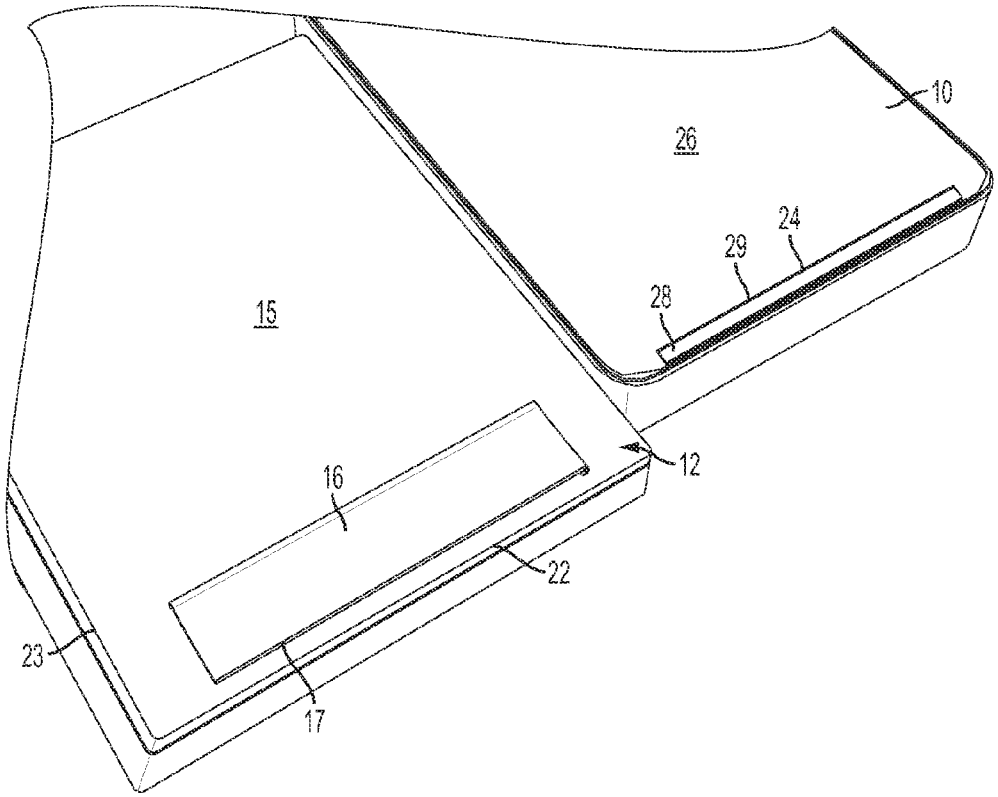
FIG. 6 is top isometric view of the bed portion of the device with the web folded in the operable position and the mattress inverted next to the bed frame showing the mattress portion of the device.
Figure 7:
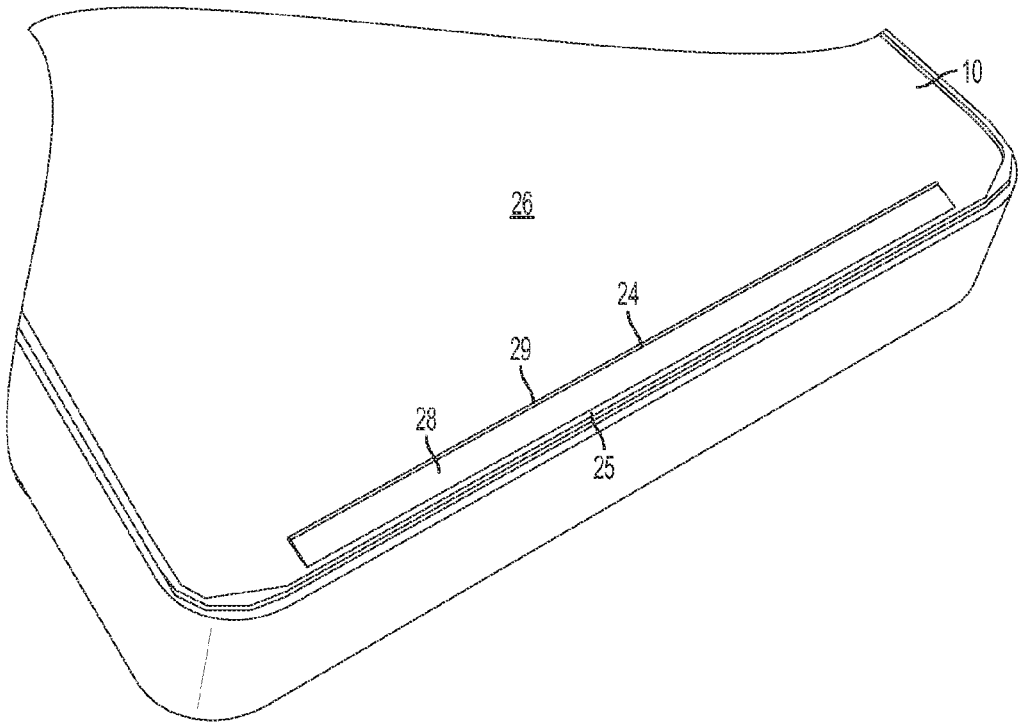
FIG. 7 is a bottom isometric view of the mattress (mattress inverted) showing the mattress portion of the device.

A mating element 24 is attached to a bottom surface 26 of the mattress adjacent the edge to be restrained, longitudinal edge 25 as shown in FIGS. 6 and 7 for this example. FIG. 6 demonstrates the relative positioning of the operable elements showing the mattress inverted next to the articulating support structure. The mating element 24 also incorporates a web section 28, for flexibility in attachment as will be described subsequently, attached at a first edge to the mattress and a second moiety 29 for the fastener carried on a second edge. The fastener and mating fastener are Zippers or Velcro elements in representative embodiments.

Figure 8:
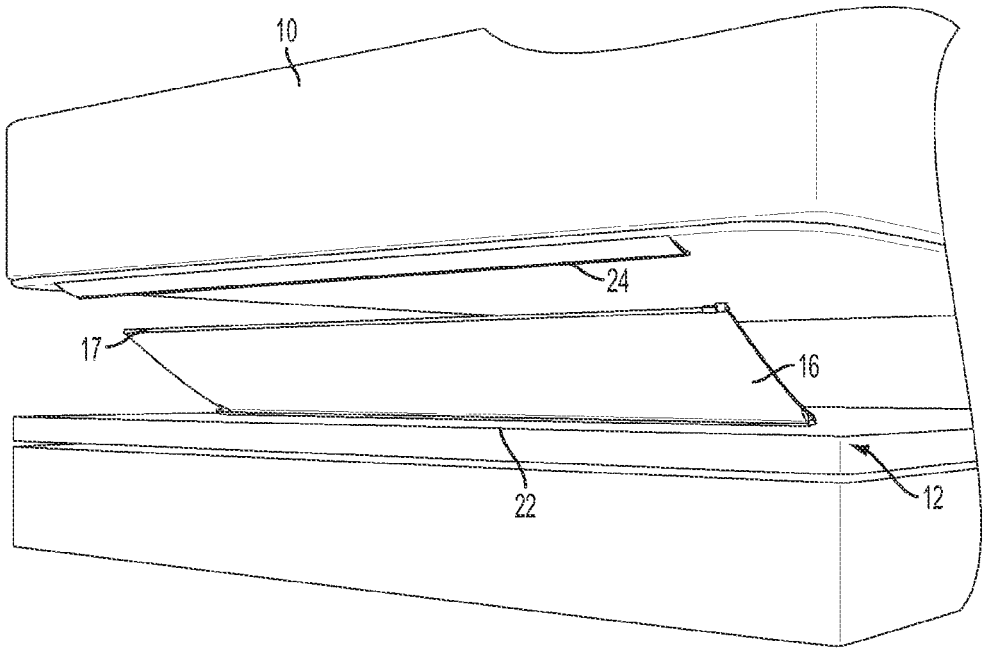
FIG. 8 is an isometric view of the mattress and bed frame showing the bed portion and mattress portion of the device extended for mating.
Figure 9:
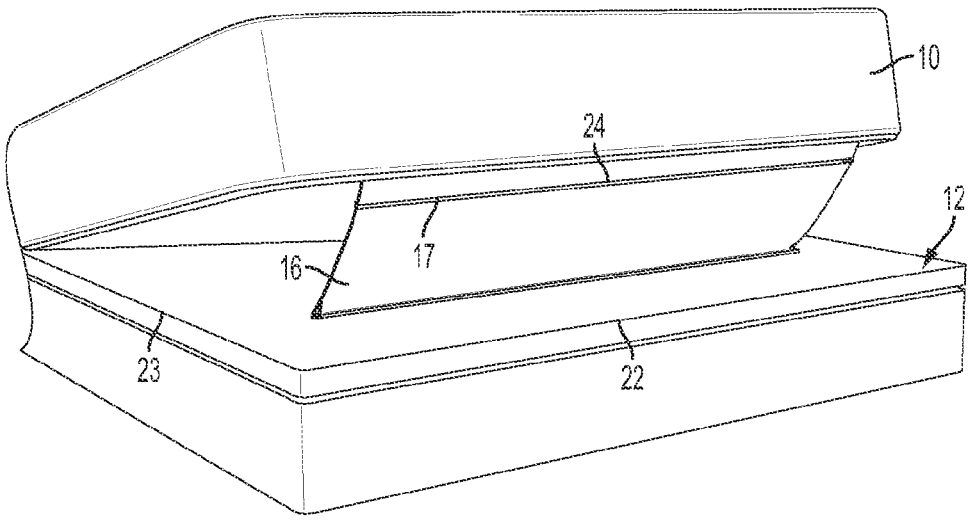
FIG. 9 is an isometric view of the mattress and bed frame showing the bed portion and mattress portion of the device mated.
Figure 10:
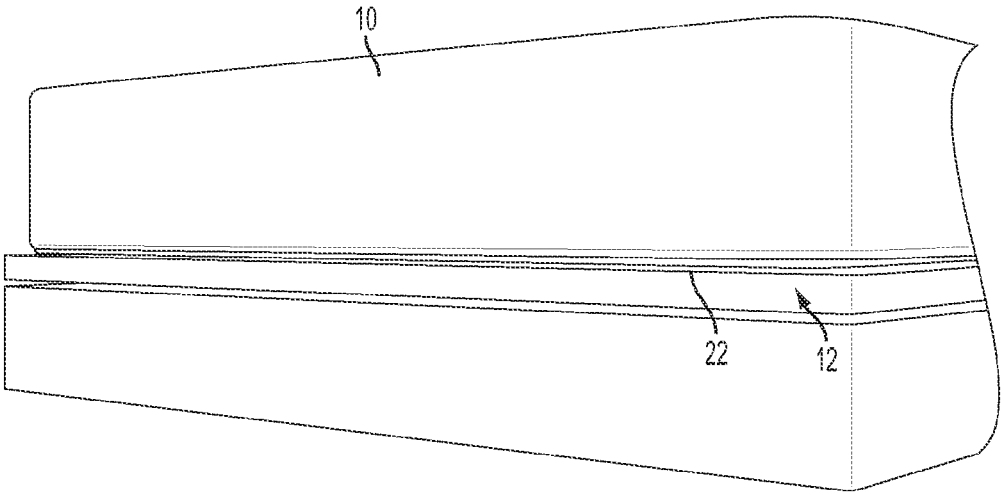
FIG. 10 is an isometric view of the mattress on the bed frame in the flat position.

As shown in FIG. 8 with the mattress positioned over the support structure with the companion edges aligned, the restraining web with the first moiety of the fastener and the mating element with the second moiety of the fastener are aligned to be joined. While shown as suspended over the support structure in the figure, the mattress is sufficiently flexible to allow lifting of only the edge portion for connecting the fastener moieties with the articulating support structure in the flat or unarticulated position. Connecting the fastener moieties as shown in FIG. 9 secures the mattress to the support structure. The length of the web and attachment position at the tension strip, setback from the longitudinal edge and the lateral edges of the mattress and support structure edge, allow easy fitting of sheets and other bedding on the mattress in a conventional fashion. However the joined restraining web and web section of the mating element are of a length substantially identical to a longitudinal length from the tension strip to the edge being restrained with the mattress in a flat position to provide tension upon articulation of the support structure as shown in FIG. 1, which restrains the mattress edge from lifting.

Figure 11A:
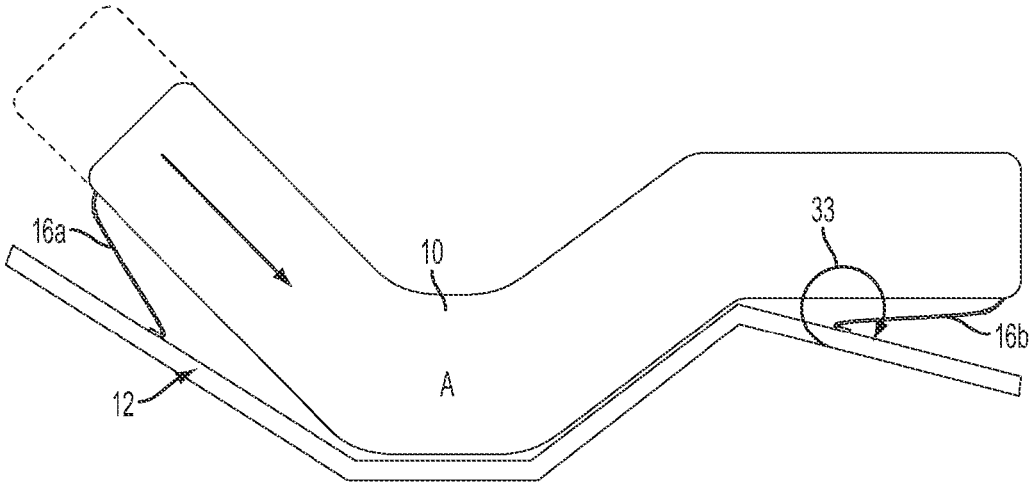
FIG. 11A is a side view demonstrating incorporation of the embodiments described for both a head portion and a foot portion of the articulating bed.
Figure 11B:
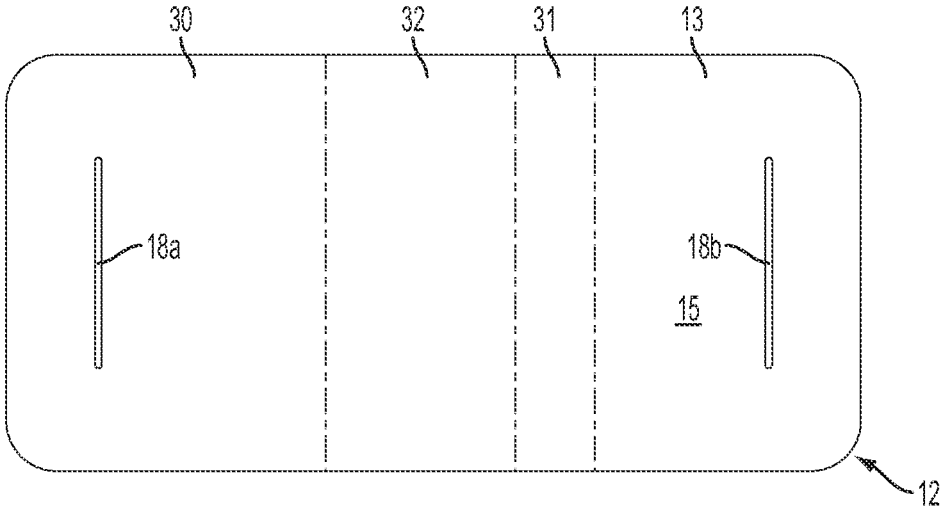
FIG. 11B is a top view of the articulating support structure demonstrating the tension member attachment for the embodiment of FIG. 11A.

As shown in FIG. 11A, placing paired restraining webs 16*a* and 16*b* associated with edges of the articulating support structure at the head and foot of the bed provides longitudinal tension restraint preventing lifting of companion edges on both the head and foot of the mattress as well as bridging in the seat section when respective sections are articulated (the lifting effect is shown in the drawings while in practice, the mattress is restrained firmly against the surface with opposing restraints at the head and foot preventing bridging of the mattress which would result in upward motion of the mattress as indicated by the dotted line). FIG. 11B show placement of the associated tension strips 18*a* and 18*b* for securing the restraining webs to the top surface 15 of support structure 12. For the example embodiment, the strips are attached to a foot support member 13 as described in detail above and a head support member 30. Thigh support member 31 and seat support member 32 are shown as a portion of the articulating support structure 12 for reference.

Use of the restraining webs in attachment to the mating elements creates tension in the mated system which results in a moment 33 about the lateral axis of the tension strip to urge the mattress head or foot into contact with the respective support surface.

Figure 12A:
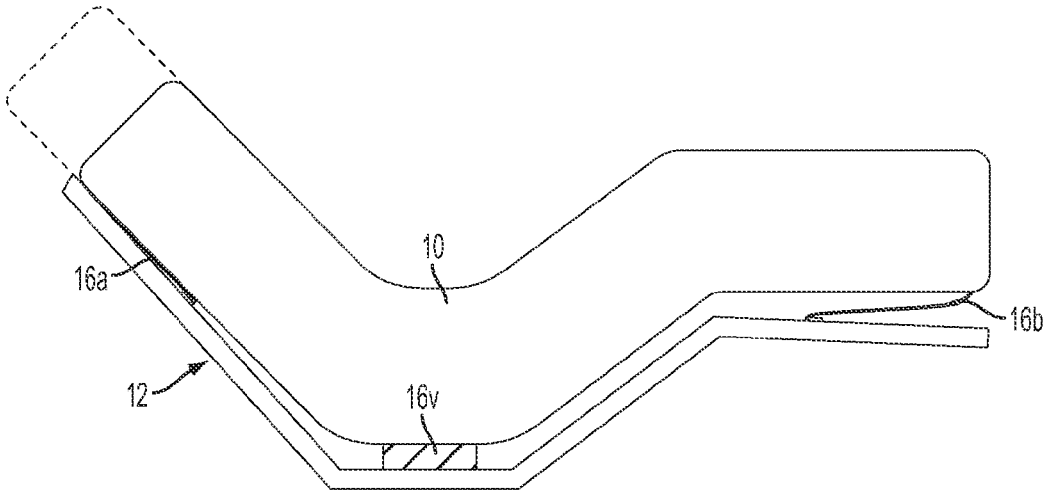
FIG. 12A is a side view of the articulating bed support elements showing an embodiment with lateral tension members in addition to the longitudinal tension members.
Figure 12B:
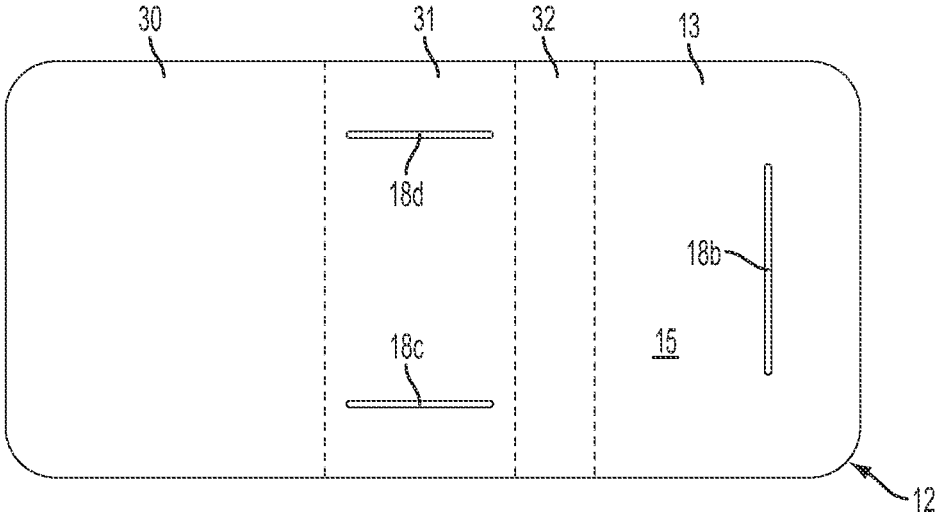
FIG. 12B is a top view of the articulating support structure demonstrating the tension member attachment for a first example of the embodiment of FIG. 12A; and, FIG. 12C is a top view of the articulating support structure demonstrating the tension member attachment for an alternative example of the embodiment of FIG. 12A.
Figure 12C:
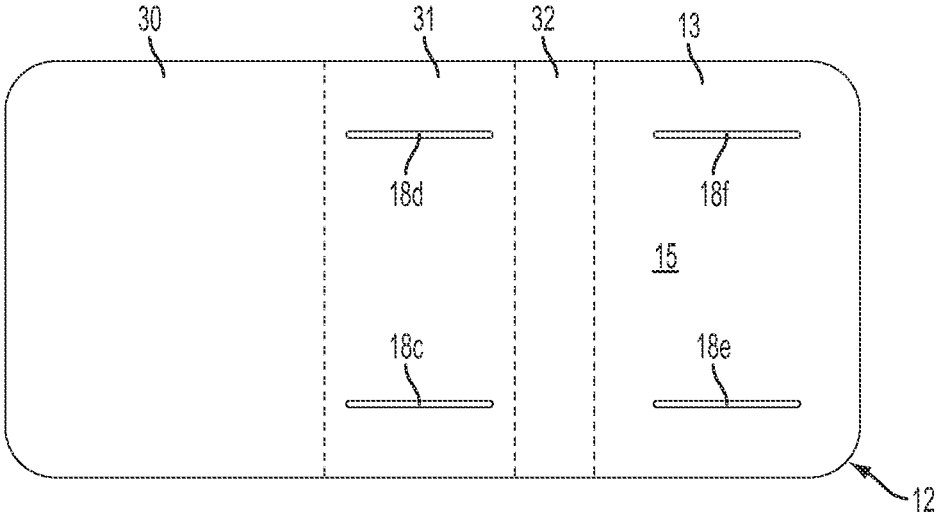

For larger bed and mattress systems, lateral restraint for the mattress may also be desired. The structure associated with the embodiments described above may also be applied along the lateral extents of the mattress to restrain the mattress from lifting. As shown in FIG. 12A, with the mattress shown positioned lifted from the support structure, lateral tension webs 16*c* may be employed. FIG. 12B shows the attachment locations for tension strips 18*c* and 18*d* for securing the lateral tension webs. As shown in FIG. 12C, lateral tension webs may also be used as alternatives to longitudinal webs with tension strips 18*e* and 18*f* replacing tension strip 18*b*.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A mattress retention system for adjustable beds comprising:

a tension web attached to a top surface of a foot support member of an articulating support structure, said tension web being inset a distance from an adjacent foot edge of said foot support member and said tension web having a transverse width extending over a center portion and the majority of an overall width of the foot support member, said tension web being inset from the foot edge and adjacent lateral edges of the foot support member, said tension web having a first fastener moiety on an extending edge; and a mating element attached to a bottom surface of a mattress proximate the adjacent foot edge to be restrained, said mating element having a second fastener moiety for operable connection to the first fastener moiety, the attached tension web and mating element being of a length substantially identical to a longitudinal length of the distance and the longitudinal length of the tension web being less than the transverse width of the tension web.

2. The mattress retention system as defined in claim 1 wherein the tension web is attached to the top surface with a tension strip extending over said center portion and capturing an attachment edge of the tension web.

3. The mattress retention system as defined in claim 2 wherein the tension strip is fixed to the top surface with spaced fasteners.

4. The mattress retention system as defined in claim 1 wherein the mating element includes a web section having a first edge attached to the bottom surface of the mattress and a second edge carrying the second fastener moiety.

5. The mattress retention system as defined in claim 1 wherein the longitudinal edge is at the mattress foot.

6. The mattress retention system as defined in claim 1 wherein the edge of the mattress to be restrained is a lateral edge.

7. An adjustable bed comprising:

a support structure having an articulating foot support member with a top surface, a foot edge and lateral edges;

a mattress received on the support structure on the top surface of the articulating foot support member and having an adjacent foot edge and adjacent lateral edges;

a tension web attached to the top surface of the articulating foot support member, said tension web being inset a distance from the foot edge and said tension web having a transverse width extending over a center portion and the majority of an overall width of the foot support member, said tension web being inset from the foot edge and adjacent lateral edges, said tension web having a first fastener moiety on an extending edge; and a mating element attached to a bottom surface of the mattress proximate the adjacent foot edge to be restrained, said mating element having a second fastener moiety for operable connection to the first fastener moiety, the attached tension web and mating element being of a length substantially identical to a longitudinal length of the distance and the longitudinal length of the tension web being less than the transverse width of the tension web.

8. The mattress retention system as defined in claim 7 wherein the at least one tension web is attached to the top surface with a tension strip capturing an attachment edge of the tension web.

9. The mattress retention system as defined in claim 8 wherein the tension strip is fixed to the top surface with spaced fasteners.

10. The mattress retention system as defined in claim 7 wherein the mating element includes a web section having a first edge attached to the bottom surface of the mattress and a second edge carrying the second fastener moiety.

11. The mattress retention system as defined in claim 7 wherein the longitudinal edge is at the mattress foot.

12. The mattress retention system as defined in claim 7 wherein the edge of the mattress to be restrained is a lateral edge.

* * * * *